United States Patent [19]

Inuyama

[11] Patent Number: 5,012,057

[45] Date of Patent: Apr. 30, 1991

[54] TRIGGER SWITCH

[75] Inventor: Tsutomu Inuyama, Yatsuka, Japan

[73] Assignee: Omron Tateisi Electronics Co., Kyoto, Japan

[21] Appl. No.: 323,024

[22] Filed: Mar. 15, 1989

[30] Foreign Application Priority Data

Mar. 15, 1988 [JP] Japan ..... 63-33266[U]

[51] Int. Cl.[5] ..... H01H 13/02

[52] U.S. Cl. ..... 200/522; 200/332.2; 200/43.17

[58] Field of Search ..... 200/522, 333.2, 293.1, 200/43.17, 305, 43.08; 174/556, 5 R

[56] References Cited

U.S. PATENT DOCUMENTS

| | | | |
|---|---|---|---|
| 2,928,921 | 3/1960 | Cranmore | 200/522 |
| 3,329,789 | 7/1967 | Sahrbacker | 200/522 |
| 3,711,666 | 1/1973 | Sahrbacker | 200/522 |
| 3,745,286 | 7/1973 | Sahrbacker | 200/522 |
| 3,829,645 | 8/1974 | Piber | 200/43.17 |
| 3,872,274 | 3/1975 | Piber | 200/43.17 |
| 4,639,562 | 1/1987 | Fredrickson | 200/43.08 |

FOREIGN PATENT DOCUMENTS

| | | | |
|---|---|---|---|
| 587367 | 11/1959 | Canada | 200/522 |

*Primary Examiner*—Henry J. Recla
*Assistant Examiner*—Glenn T. Barrett
*Attorney, Agent, or Firm*—Fish & Richardson

[57] ABSTRACT

A trigger switch includes a trigger member pivotally attached to a grip member via a pivot pin and connected to an electric switch main body. By pressing and pivotally moving the trigger member, the switch main body can be actuated. To avoid inadvertent actuation of the switch main body, a lateral lock pin is passed through a slot provided in a metallic lock plate securely attached to the trigger member and a hole provided in the grip member so as to secure the trigger member immobile by engaging a large diameter portion of the lock pin in an expanded part of the slot of the metallic lock plate and release the trigger member by moving the large diameter portion out of the slot. To increase the margin of an insulation distance, the metallic lock plate is placed a certain distance away from the pivot pin.

3 Claims, 3 Drawing Sheets

31
32
33
33a
34
35
36
37
37a
37b
37c
38
38a
38b
38c
39
40
41
42
43
44
45
46
46a
46b
47
48
49
49a
50
51
52

TRIGGER SWITCH

TECHNICAL FIELD

The present invention relates to a trigger switch which is suitable for use in electric power tools and other applications, and in particular to such a trigger switch equipped with with a lock mechanism which is required to be released for activation thereof as a safety measure.

BACKGROUND OF THE INVENTION

Trigger switches are typically used in power tools such as electric drills. In such an electric power tool, a trigger switch is arranged in its grip so as to be operated with a single hand, and a trigger member is provided in front of the grip in the manner of a pistol trigger. Typically, the trigger member is provided with a front end which is adapted to be pressed by a finger of the user and a pair of side walls extending rearwardly therefrom. An upper part of the trigger member is pivotally supported by a planar member which is connected to the grip and adapted to be received between the two side walls of the trigger member as it is pulled. To prevent inadvertent activation of the electric switch and to thereby ensure the safety of the switch operation, the trigger member is normally provided with a lock mechanism which is required to be released for the switch to be activated.

The lock mechanism may comprise an arcuate slot provided in the trigger member, having a center of curvature at the pivot center of the trigger member and a locally expanded portion at its rear end. A lock pin is passed laterally through a hole provided in the planar member of the grip and through the arcuate slot of the lock member. The lock pin is provided with a large diameter portion which has a larger diameter than the width of the arcuate slot but can fit into the locally expanded portion of the arcuate slot, and a small diameter portion which can be passed through the arcuate slot. Further, the lock pin can move axially so that either the large diameter portion or the small diameter portion of the lock pin may be selectively placed in the arcuate slot. Typically, the lock pin is biased by a spring member into a position where the large diameter portion of the lock pin is received in the locally expanded portion of the arcuate slot.

Therefore, simply pressing the front end of the trigger member would not cause the pivotal motion of the trigger member because the large diameter portion of the safety catch pin is held in the locally expanded portion of the arcuate slot and cannot move through the arcuate slot. However, when the lock pin is pushed axially against the spring force so that the large diameter portion may be placed out of the arcuate slot, it becomes possible to pivotally move the trigger member by pressing the front end thereof.

In such a trigger switch, the mechanical durability of the slot is important because the lock pin is typically made of metallic material but the trigger member is often made of resin or aluminum alloy material.

It is conceivable to securely attach a metallic lock plate to the trigger member to define the arcuate slot, but the direct contact between the pivot pin and the arcuate slot is not desirable. Even though neither the metallic pivot pin nor the lock plate may be connected to any electric part of the trigger switch, the electric coupling between the pivot pin and the lock plate would not be desirable particularly because the pivot pin is typically exposed to the user.

BRIEF SUMMARY OF THE INVENTION

In view of such problems of the prior art, a primary object of the present invention is to provide a trigger switch which is durable to use and economical to manufacture.

A second object of the present invention is to provide a trigger switch which has a large margin of an insulation distance.

A third object of the present invention is to provide a trigger switch which is mechanically durable and electrically safe.

These and other objects of the present invention can be accomplished by providing a trigger switch, comprising: a grip member having a lock pin receiving hole; a trigger member, made of resin material, having a front end adapted to be pressed and a side wall, and pivotally attached to the grip member by way of a metallic pin passed through the grip member; trigger spring means urging the front end away from the grip member; an electric switch main body adapted to be actuated by the pivotal movement of the trigger member; a metallic lock plate fixedly secured to the side wall of the trigger member and provided with a slot having an expanded portion and a narrow portion; a lock pin passed through the lock pin receiving hole of the grip member and the slot provided in the metallic lock plate so as to be axially moveable, the pivot pin being provided with a large diameter portion which can be received in the expanded portion of the slot but cannot be received in the narrow portion of the slot; and lock pin spring means normally urging the large diameter into the expanded portion.

Thus, the use of the metallic lock plate ensures the mechanical durability of the lock mechanism.

In such a switch, a favorable electric insulation property is required, and it is therefore desirable if no conductive part is exposed externally of the switch. However, since the pivot pin is exposed and typically made of a metallic material and the trigger member must be partly made of metallic material for cooperating with a lock pin, it is therefore desired that the metallic lock plate is placed a certain distance away from the pivot pin.

According to a preferred embodiment, the metallic lock plate is fitted into a conformal depression provided in the side wall for reducing the overall width of the trigger member and increase the degree of mechanical attachment between the metallic lock plate and the trigger member. To better achieve this goal, the metallic lock plate may be inert molded with the trigger member. Since the part of the trigger member which is coupled with the main body of the electric switch is typically placed under relatively severe stress condition, it is desired that the metallic lock plate is provided with a hole for coupling a connecting rod thereto for actuating the electric switch.

BRIEF DESCRIPTION OF THE DRAWINGS

Now the present invention is described in the following with reference to the appended drawings, in which.

DESCRIPTION OF THE PREFERRED EMBODIMENT

Figures 1, 2:
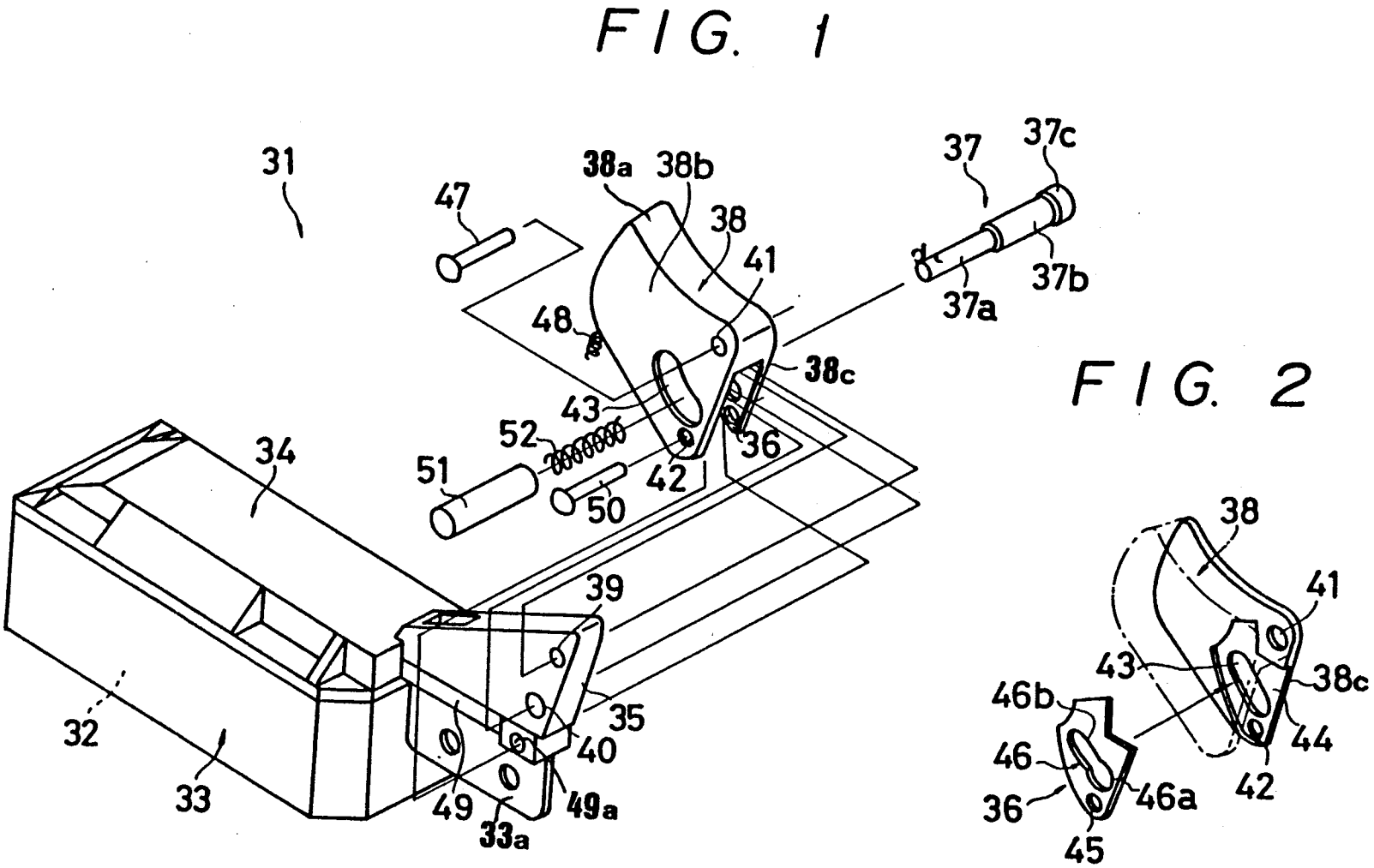
FIG. 1 is an exploded perspective view of an embodiment of the trigger switch according to the present invention.
FIG. 2 is a fragmentary exploded perspective view of an essential part of the trigger switch.
Figure 3:
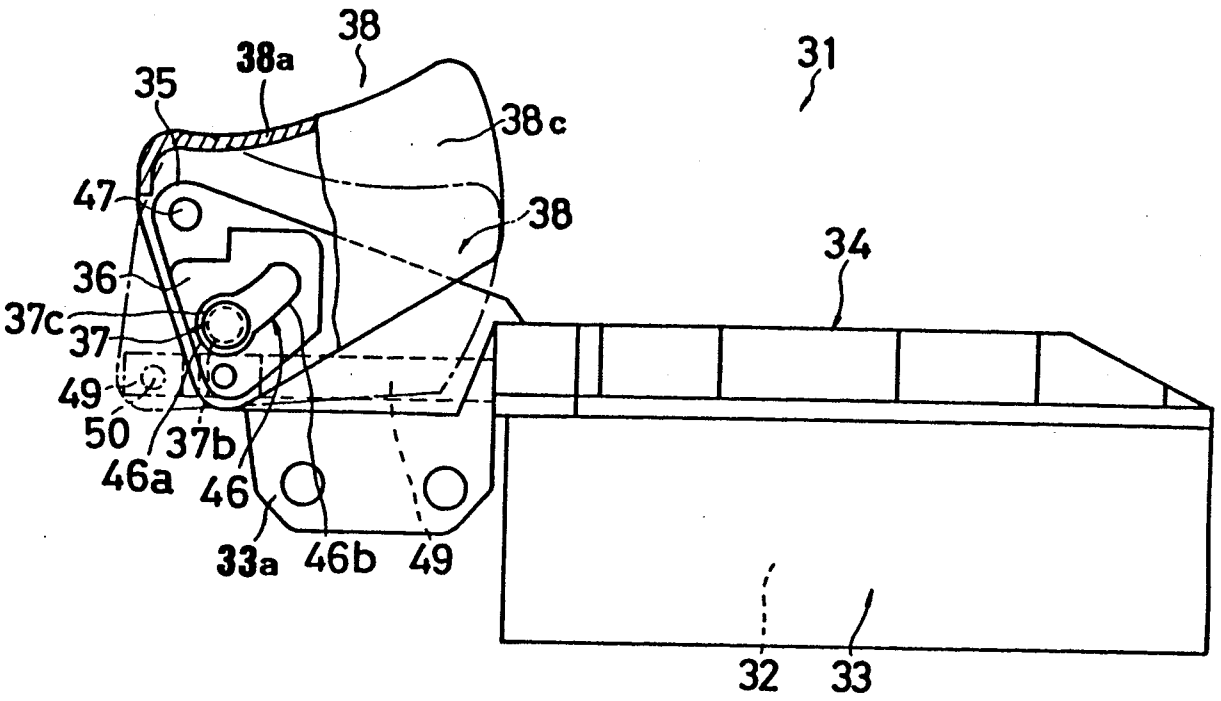
FIG. 3 is a partly broken away side view of the trigger switch.

FIG. 1 shows an embodiment of the trigger switch according to the present invention. This trigger switch 31 is provided with a box-shaped casing 33 serving as a grip of an electric power tool and accommodating a switch main body 32 therein, and the open front end (the upper end as seen in FIG. 1) is closed by a cover 34. The casing 33 and the cover 34 are both made of thermoplastic resin.

The upper end of the cover 34 is integrally provided with a planar projecting piece 35 made of resin material for pivotally supporting a trigger mechanism as described hereinafter and the casing 33 is similarly provided with a planar bracket 33*a*, made of insert molded metallic member, for connecting this trigger switch 31 to the main body of the electric power tool not shown in the drawings A lateral hole 39 rotatably supports a trigger member 38 by way of a pivot pin 47 which is passed through the hole 39 and a hole 41 provided in the trigger member 38. The trigger member 38 comprises a front wall 38*a* and a pair of lateral walls 38*b* and 38*c* mutually connected by the front wall 38*a* and defining an open space therebetween. A compression coil spring 48 interposed between the inner surface of the front wall 38*a* of the trigger member 38 and the front end surface of the projecting piece 35 urges the front wall 38*a* away from the front end of the projecting piece 35.

A connecting rod 49 is slidably received between the projecting piece 35 and the bracket 33*a* into and out of the casing 33 for actuating the electric switch main body 32 acommodated in the casing 33, and is provided with a lateral hole 49*a* at its upper end. The upper and rear end of each of the side walls 38*b* and 38*c* is provided with a hole 42. A pin 50 is passed through the holes 42 and 49*a* so that the connecting rod 49 may be moved into and out of the casing 33 as the trigger member 38 is rotated about the pivot pin 47 by pressing the front wall 38*a* of the trigger member 38 against the spring force of the compression coil spring 48 and releasing it.

Each of the side walls 38*b* and 38*c* of the trigger member 38 is provided with an arcuate slot 43 having a center of curvature at the pivot pin 47, and a lateral hole 40 provided in the projecting piece 35 aligns with these slots 43. The inner surface of one of the side walls 38*c* is provided with a depression 44 which encompasses the entire slot 43 and the hole 42 but avoids the hole 41 for receiving the pivot pin 47. This depression 44 receives a metallic lock plate 36 which is substantially conformal and complementary to this depression 44, and is securely attached thereto, for instance, by insert molding. This metallic lock plate 36 is provided with a hole 45 which aligns with the hole 42 and an arcuate slot 46 which aligns with the slot 43. The holes 42 and 45 have a substantially same diameter, but the arcuate slot 46 of the metallic lock plate 36 is provided with a main part 46*b* having a substantially narrower width than the slot 43 of the trigger member 38 and an expanded portion 46*a* which has a substantially same width as the slot 43 of the trigger member 38 at the rear end of the slot 46.

Figure 4:
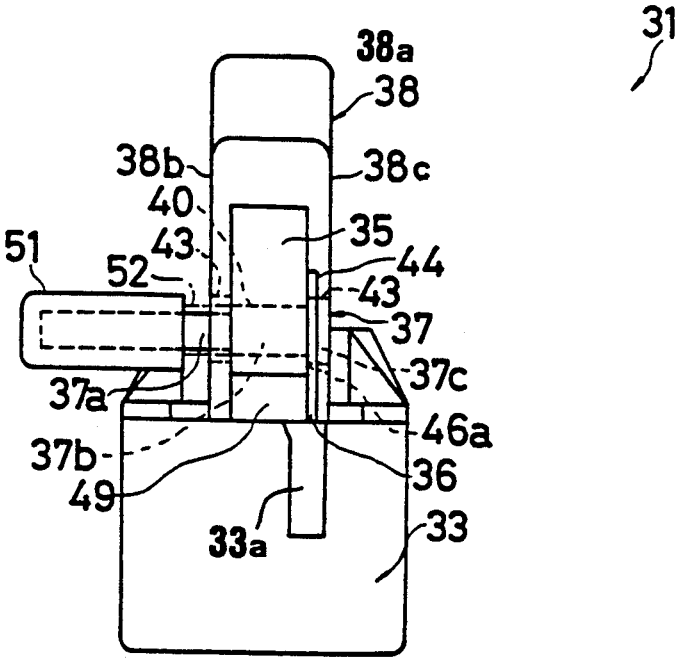
FIG. 4 is a front view of the trigger switch.

Further, as best shown in FIGS. 1 and 4, a lock pin 37 is slidably passed through the slot 43 of one of the side walls 38*c* of the trigger member 38, the slot 46 of the metallic lock plate 36, the hole 40 of the projecting piece 35 and the slot 43 of the other side wall 38*b* of the trigger member 38, in that order. The pin 37 is provided with, as seen from its front end, a small diameter portion 37*a*, an intermediate diameter portion 37*b* which is passed through the lock pin passing hole 40 of the projecting piece 35 and can pass freely through the slots 43 and 46 of the trigger member 38 and the metallic lock plate 36, respectively, and a large diameter portion 37*c* which can be received in the expanded portion 46*a* of the slot 46 of the lock plate 36 but cannot pass through the main part 46*b* of the slot 46.

The small diameter portion 37*a* of the lock pin 37 is completely passed laterally through the trigger member 38 and a cap 51 is fixedly fitted thereon. The diameter of the cap 51 may be larger than the width of the slot 43. A compression coil spring 52 is interposed between the cap 51 and the periphery of the hole 40 so as to urge the lock pin 37 to the left as seen in FIG. 4. As a result, under normal condition, the large diameter portion 37*c* of the lock pin 37 is received in the expanded portion 46*a* of the slot 46 of the metallic lock plate 36 and abuts the periphery of the hole 40 on the surface of the projecting piece 35 opposite to the surface on which the compression coil spring 52 abuts.

Now the operation of this trigger switch 31 is described in the following.

Under the normal condition mentioned above, since the large diameter portion 37*c* is received in the expanded portion 46*a* but cannot pass through the main part 46*b* of the slot 46, the trigger member 38 remains stationary even when an attempt is made to pull the front wall 38*a* of the trigger member 38.

However, when the cap 51 is pressed to the right as seen in FIG. 4 against the spring force of the compression coil spring 52, the large diameter portion 37*c* of the lock pin 37 is pushed out of the expanded portion 46*a* of the slot 46 of the metallic lock plate 36 and received in the slot 43 of one of the side walls 38*c* of the trigger member 38 whereby it becomes possible to rotate the trigger member 38 around the pivot pin 47 by pulling or pressing upon the front wall 38*a* of the trigger member 38 against the spring force of the compression coil spring 48. As the trigger member 38 is thus depressed by pressing the front wall 38*a* of the trigger member 38, the lock pin 37 moves along the slots 43 and 46. When the cap 51 is released thereafter, the large diameter portion 37*c* or its shoulder surface abuts the periphery of the main part 46*b* of the slot 46 and slides along it.

When the trigger member 38 is released and returns to its initial position under the spring force of the compression coil spring 48, the large diameter portion 37*c* of the lock pin 37 again drops into the expanded portion 46*a* under the spring force of the compression coil spring 52.

Thus, the trigger member 38 is locked up against its rotation by the engagement between the large diameter portion 37*c* of the lock pin 37 and the expanded portion 46*a* of the slot 46 of the lock plate 36. In order to actuate the trigger member 38, it is necessary to push the cap 51, but, once the trigger member 38 is even slightly depressed from its initial position, the cap 51 may be released while the trigger member 38 is kept pulled. However, the lock pin 37 is brought back to its initial position when the trigger member 38 is brought back to its initial position Therefore, according to this trigger switch 31, in the inoperative state of the trigger member 38, the connecting rod 49 turns off the switch main body 32 and this off state is maintained by the engagement between the large diameter portion 37*c* of the lock pin 37 and the expanded portion 46*a* of the slot 46 provided in the lock plate 36. Further, by pressing the trigger member 38 into rotary movement while pressing the cap 51, the connecting rod 49 is displaced forwardly and the switch main body 32 is switched over to the on state.

Since the lock plate is fitted into a depression which avoids the pivot center of the trigger member, even when a metallic pivot shaft is used in the pivot center, it can be provided with a sufficient insulation distance and a favorable insulation state can be attained.

What we claim is:

1. A trigger switch, comprising:

a grip member having a lock pin receiving hole;

a trigger member made of resin material and having a front end adapted to be pressed and a side wall;

a metallic pivot pin passing through said grip member for pivotally attaching said trigger member to said grip member;

trigger spring means for urging said front end of said trigger member away from said grip member;

an electric switch main body adapted to be actuated by pivotal movement of said trigger member;

a metallic lock plate fixedly secured to said side wall of said trigger member and provided with a slot having an expanded portion and a narrow portion, said lock plate being spaced from said pivot pin;

a lock pin passing through said lock pin receiving hole of said grip member and said slot provided in said lock plate so as to be axially movable, said lock pin having a large diameter portion and a small diameter portion, the large diameter portion of which can be received in said expanded portion of said slot but which cannot be received in said narrow portion of said slot;

lock pin spring means normally urging said large diameter portion of said lock pin into said expanded portion of said slot; and a cap fitting over the small diameter portion of the lock pin against which a force can be applied against the urging of the lock pin spring means.

2. A trigger switch according to claim 1, wherein said metallic lock plate is fitted into a conformal depression provided in said side wall.

3. A trigger switch according to claim 2, wherein said metallic lock plate is provided with a hole for coupling a connecting rod thereto for actuating said electric switch.

* * * * *